United States Patent [19]

Kandybowski et al.

[11] Patent Number: 4,647,129

[45] Date of Patent: Mar. 3, 1987

[54] ELECTRICAL CONNECTOR

[75] Inventors: Steven J. Kandybowski, Tower City; James L. Mixon, Jr., Harrisburg, both of Pa.

[73] Assignee: AMP Incorporated, Harrisburg, Pa.

[21] Appl. No.: 811,566

[22] Filed: Dec. 20, 1985

[51] Int. Cl.[4] ..... H01R 13/629

[52] U.S. Cl. ..... 339/64 M; 339/126 RS

[58] Field of Search ..... 339/64 R, 64 M, 126 R, 339/126 RS, 132 R, 132 B, 47 R, 49 R, 256 SP, 258 S

[56] References Cited

U.S. PATENT DOCUMENTS

| | | | |
|---|---|---|---|
| 3,040,289 | 6/1962 | Wicks | 339/64 M |
| 3,668,608 | 6/1972 | Ziegler, Jr. | 339/64 M |
| 4,552,425 | 11/1985 | Billman | 339/47 R |

FOREIGN PATENT DOCUMENTS

| | | | |
|---|---|---|---|
| 2378375 | 9/1978 | France | 339/256 SP |
| 2079545 | 1/1982 | United Kingdom | 339/47 R |
| 372860 | 5/1973 | U.S.S.R. | 339/47 C |

*Primary Examiner*—Gil Weidenfeld
*Assistant Examiner*—Gary F. Paumen
*Attorney, Agent, or Firm*—Allan B. Osborne

[57] ABSTRACT

An electrical connector including conductive contacts and a housing which comprises a support member, outwardly extending contact receiving shells attached thereto and resilient arms on the support member for mounting said connector to a bracket so that the connector may move in an x and y direction. More particularly, the resilient arms include means for being attached to the bracket and the support member includes slots for slidingly receiving rails extending outwardly from the bracket between which and on which the connector is movably mounted.

10 Claims, 11 Drawing Figures

10
136
148
146
140
138
145
144
142
146
68
70
16
3
32
30
34
56
54
150
152
154
22
50
46
58
62
66
64
28
60
18
38
40
72
52
74
48
82
12
20
24
14

46
24
16
42
60
36
88
64
66
74
90
18
62
86
80
84
22
82

100
102
110
116
98
104
106
92
94
96
130
134
112
128
118
132
120

ELECTRICAL CONNECTOR

FIELD OF THE INVENTION

The invention disclosed herein relates to an electrical connector including a contact housing with flexible mounting arms for attachment to a stationary bracket to permit the housing to move in the x and y directions and to the contact received in the housing.

BACKGROUND OF THE INVENTION

U.S. Pat. No. 4,423,917 discloses an electrical connector for use in situations where misalignment between the connector and mating terminals is likely and where blind mating occurs. In this known connector, the housing is rigidly mounted; e.g., on a sliding drawer on a computer rack, and the contacts within the housing are mounted therein for both rotational and vertical movement to facilitate receiving misaligned terminals thereinto through opposing ends of the housing.

Although the aforementioned electrical connector is well suited for its intended purpose, it is not well adaptable to situations where not only misaligned terminals or mating contacts are present but where vibrational forces are present and the connector must have some freedom of movement.

It is, therefore, necessary to provide an electrical connector that can be mounted to a stationary bracket and have freedom to move in the x and y directions.

SUMMARY OF THE INVENTION

According to the present invention, an electrical connector for use with a bracket having a pair of spaced apart rails attached to and extending outwardly from a plate, comprises a dielectric housing and a plurality of conductive contacts, the housing including an elongated support member and a plurality of contact receiving shells attached to the support member and extending outwardly therefrom, the support member having a slot at each end and a pair of resilient arms attached thereto and extending therefrom, the electrical connector is movably mounted on the bracket and in a central location relative to the rails with the rails being slidingly received in the slot and with free ends of the resilient arms being attached to the plate so that upon the electrical connector being moved either or both parallel and perpendicularly relative to the rails, with the arms being resiliently deformed, the arms will restore the electrical connector to the central location upon the removal of the force moving the electrical connector.

DESCRIPTION OF THE INVENTION

Figure 1:
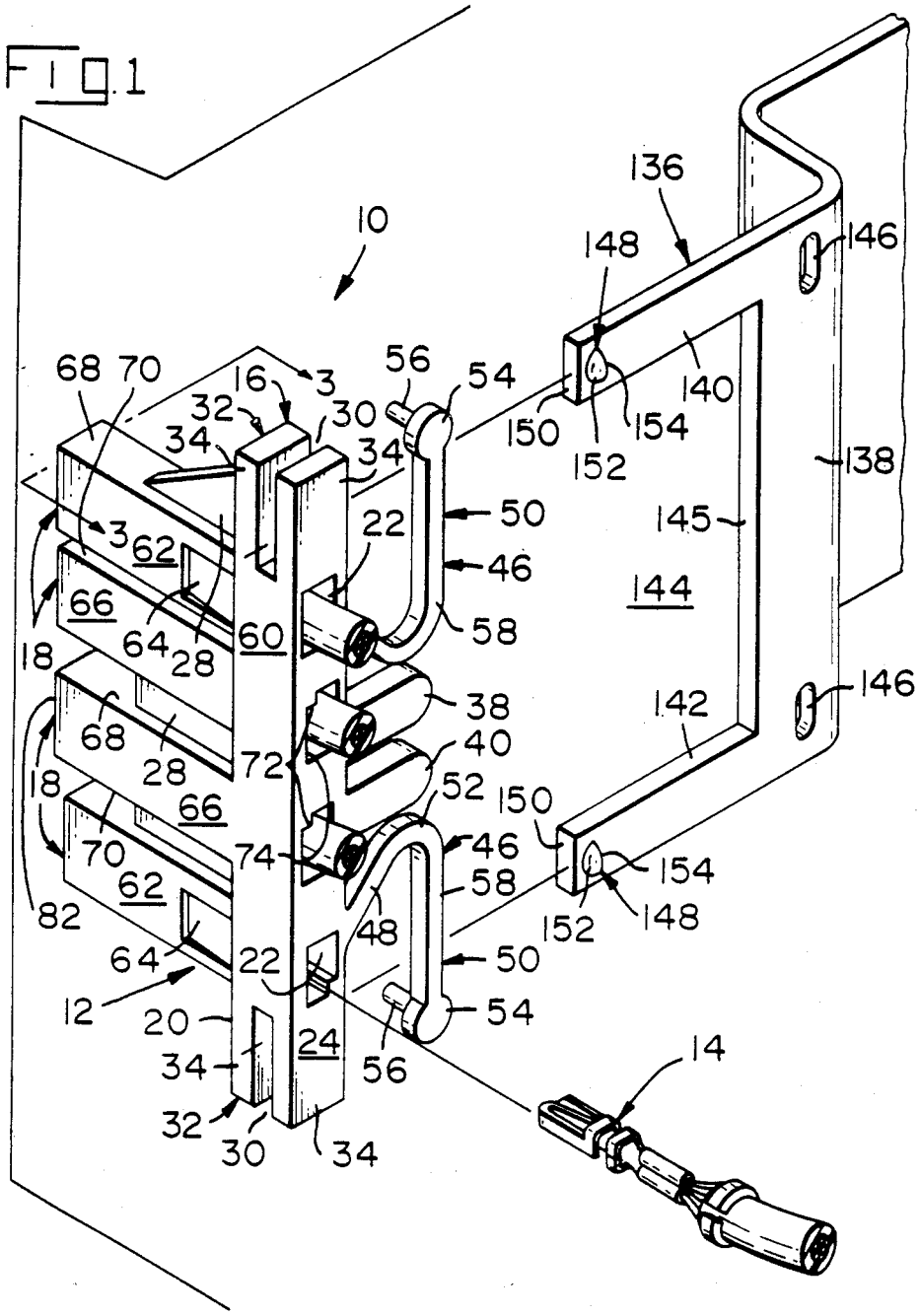
FIG. 1 is a perspective view of an electrical connector of the present invention with a contact exploded out from the housing.
Figure 2:
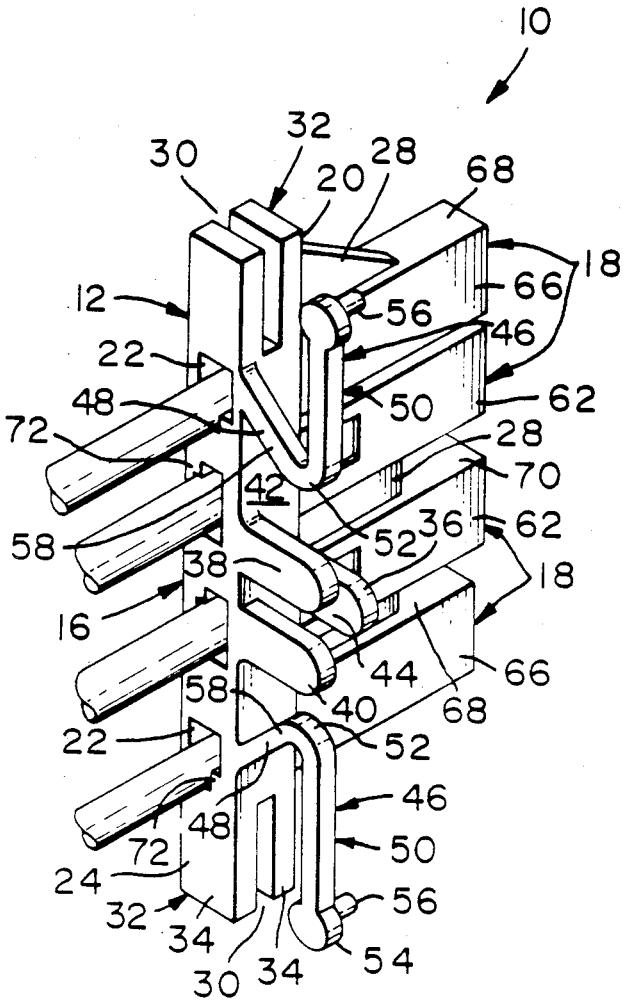
FIG. 2 is a perspective view of the electrical connector taken from another angle.

Electrical connector 10, as shown in FIGS. 1 and 2, includes dielectric housing 12 and conductive contacts 14.

Housing 12, preferably molded from a suitable plastic such as polyester sold by the General Electric Company under the trademark "VALOX", includes support member 16 and a plurality of parallel, spaced apart contact retaining shells 18. Shells 18 are attached to front surface 20 of support member 16 and extend perpendicularly away therefrom. Cavities 22, opening out onto rear surface 24 of support member 16, extend through shells 18. Stability of the elongated shells 18 is provided by reinforcing members 28.

Slots 30, extending into each end 32 of support member 16, are orientated in a direction normal to the aforementioned cavities 22 and further bifurcate each end 32 into a pair of fingers 34.

Three guide flanges 36, 38, 40 are attached to side surface 42 of support member 16 and project laterally outwardly. Flange 36 is located adjacent front face 20 and is midway between ends 32 of support member 16. Flanges 38, 40 are located adjacent rear surface 24 and are offset to either side of flange 36. The three flanges 36, 38, 40 define space 44 therebetween which is in alignment with slots 30.

J-shaped, resilient arms 46, attached to support member 16, include short portions 48, long portions 50 and rounded bight 52. One end of short portion 48 of each arm 46, attached to side surface 42 near a respective slot 30, extends obliquely outwardly in a direction towards flanges 36, 38, 40 and away from slots 30 and connects to one end of bight 52. Long portion 50, attached to another end of bight 52, extends in the reverse direction back towards the respective slot 30 and is parallel to support member 16. Free ends 54 of long portions 50 are semi-annular and carry forwardly projecting finger 56.

As shown, arms 46 are attached to side surfaces 42 with rear surfaces 58 of arms 46 on the plane of rear surface 24 of support member 16 and have a thickness not greater than the thickness of a finger 34.

Each shell 18 extends forwardly from front surface 20 of support member 16 in parallel relative to the others. However, a given shell 18 may be offset, relative to the others, towards either side surface 42 or opposing side surface 60. Further, a given shell 18 may be orientated such that side wall 62 which contains contact-retaining flap 64 may face towards one or the other side surfaces 42, 60. Shells 18 further include opposing side wall 66, top wall 68 and base wall 70. The reason for the particular orientation is to accommodate off-setting bus tabs as will be discussed further on.

Figures 3, 4:
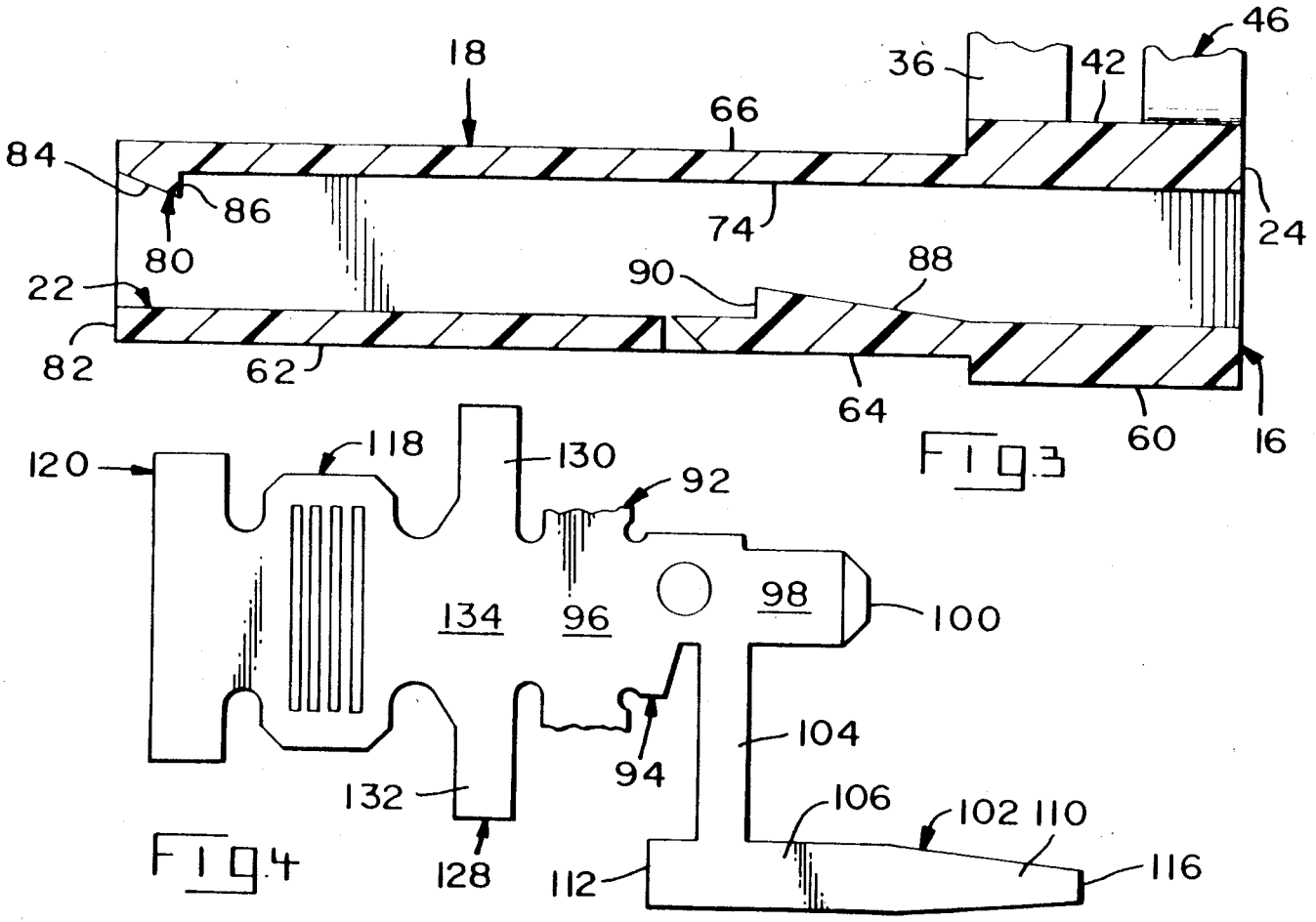
FIG. 3 is a cross-sectional side view of one contact cavity in the housing of the electrical connector of FIGS. 1 and 2.
FIG. 4 is a top plan view of a stamped blank of the contact of the electrical connector.

Cavities 22 include a step 72 located between surface 74 of opposing side wall 66 and either the inside surface (not shown) of top wall 68 or the inside surface (not shown) of base wall 70 depending on the aforementioned orientation of shells 18. Steps 72 extend from the cavity opening onto rear surface 24 through to ramp 80, as shown in FIG. 3, provided on surface 74 at the cavity opening onto front face 82 of shells 18. Ramp 80 includes a beveled lead-in surface 84 and a rearwardly facing shoulder 86. The internal features of contact-retaining flap 64 include a beveled camming surface 88 and a forwardly facing shoulder 90.

Figure 5:
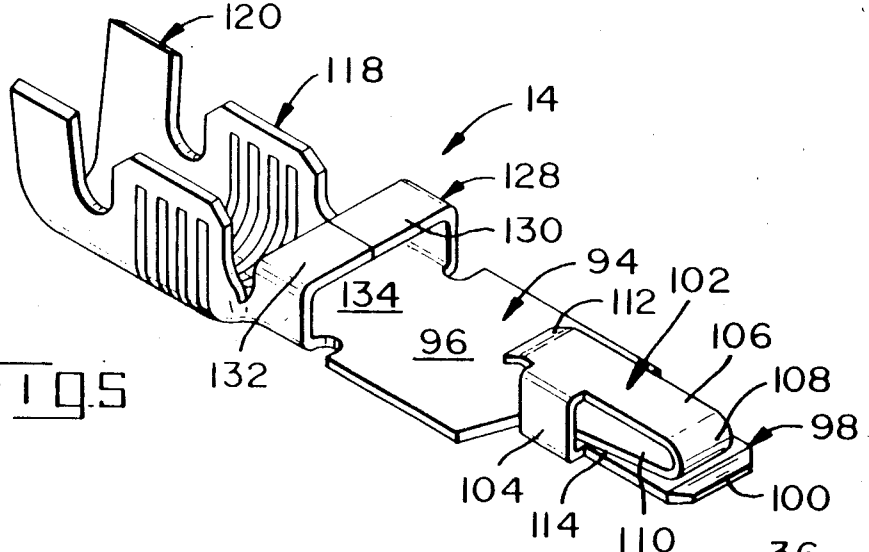
FIG. 5 is a perspective view of the contact formed from the blank of of FIG. 4.

Conductive contacts 14 are preferably stamped and formed from coplanar stock (not shown) such as iron copper and plated with tin-lead. FIG. 4 shows a contact blank 92 and FIG. 5 shows a formed contact 14. The front half of contact 14 includes blade 94 having a full-width portion 96 and a reduced-width portion 98 whose free end may be beveled on all four sides to provide a tip 100. U-shaped spring member 102 is positioned over portion 98 by means of upright strap 104 and includes first leg 106 which parallels blade 94, U-shaped bight 108 and second leg or cantilever spring arm 110 which extends obliquely rearwardly and downwardly towards blade 94. Free end 112 of first leg 106 may be curved down towards blade 94. Spring arm 110 may be bowed from side to side with the convex surface 114 (FIG. 6) facing portion 98 and free end 116 may be curved upwardly towards first leg 106 as shown in FIG. 6.

The rear half of contact 14 includes conductor receiving ferrule 118 and insulation support ferrule 120. As is well known in the art, ferrule 118 is crimped about the bared conductor ends 122 of wire 124 (FIG. 6) to effect an electrical termination and ferrule 120 is crimped about insulation 126 of wire 124 to provide support against vibration.

Intermediate the two halves of contact 14 is retaining member 128 which includes two arms 130, 132 formed to extend up from the sides of and over strap 134 which connects blade 94 with ferrule 118.

Figure 6:
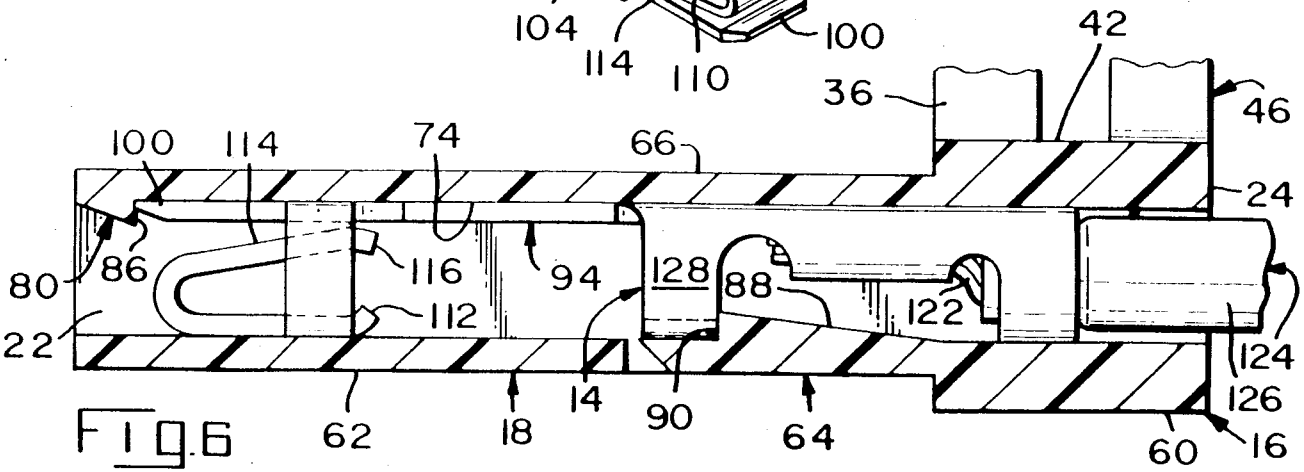
FIG. 6 is the same view as in FIG. 3 but with a contact in the cavity.

FIG. 6 shows contact 14 positioned in cavity 22 and retained therein by shoulders 86, 90 engaging respectively tip 100 and retaining member 128. Wire 124 has been crimped into ferrules 118, 120. Contact 14 is inserted into cavity 22 from the cavity opening on rear surface 24 of support member 16 with blade 94 being alongside step 72 and against surface 74. As contact 14 is moved in, retaining member 128 engages beveled surface 88 and flap 64 is resiliently cammed outwardly. Upon member 128 passing shoulder 90, flap 64 springs back in which places forwardly facing shoulder 90 behind member 128 and accordingly removably locks contact 14 in cavity 22 against withdrawal. Tip 100 abuts rearwardly facing shoulder 86 on ramp 80 which stops further forward movement of contact 14.

With reference to FIG. 1, mounting bracket 136 shown therein is formed from any suitable rigid material and includes plate 138 and outwardly extending, spaced apart upper and lower rails 140, 142 respectively. Rails 140, 142 which are less wide than the depth of slots 30, define connector-receiving space 144 therebetween which is open opposite edge 145 of plate 138 to which rails 140, 142 are attached. An oval shaped hole 146 extending through plate 138 is provided adjacent each rail 140, 142 with the major axis being normal to the axis of rails 140, 142. Bosses 148 are embossed or otherwise provided on each rail 140, 142 adjacent free ends 150. Bosses 148 include a curved surface 152 facing free ends 150 and shoulder 154 facing in the opposite direction; i.e., towards oval holes 146.

Figure 8:
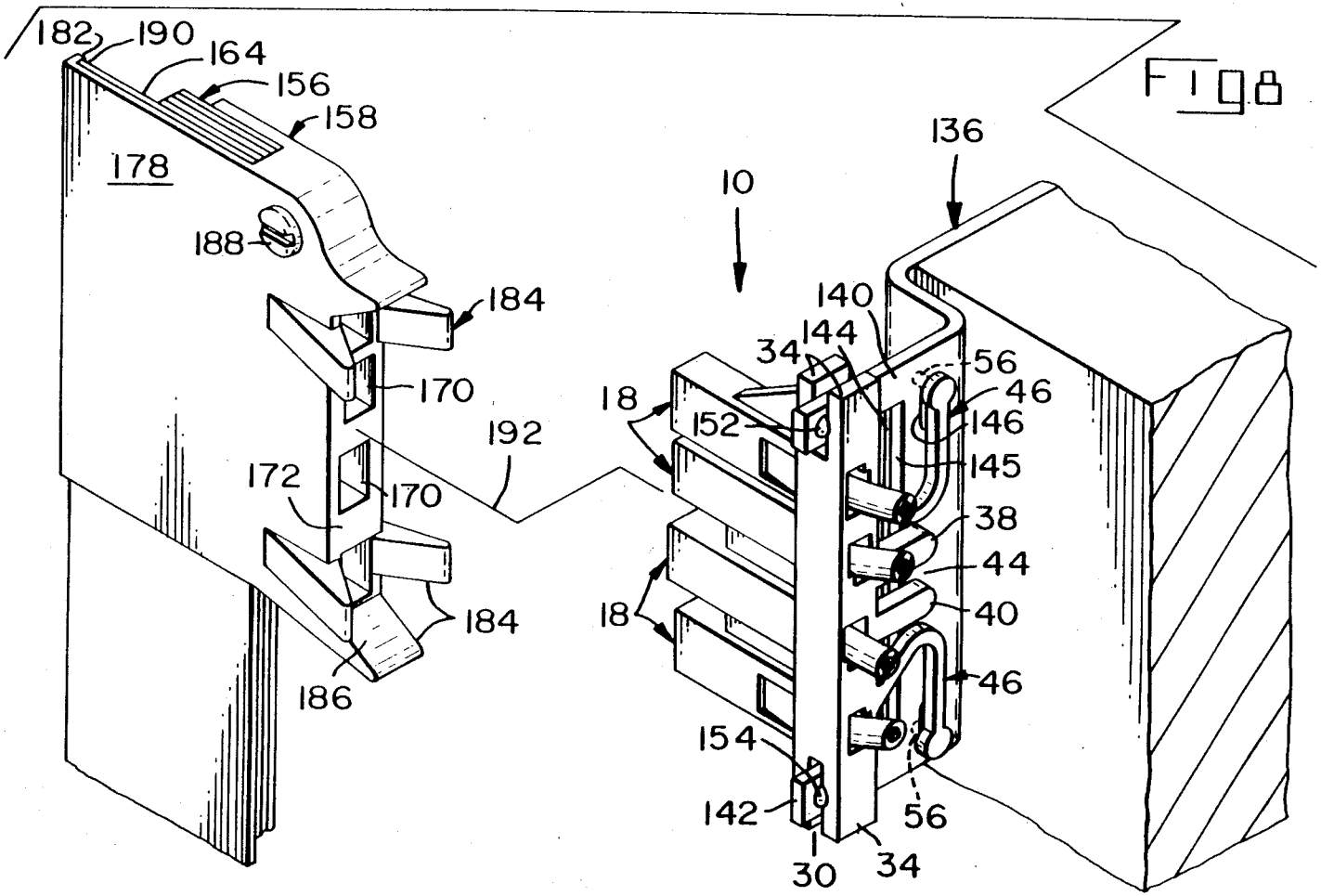
FIG. 8 is a perspective exploded view of the electrical connector and the bus bar shroud preparatory to mating.
Figure 10:
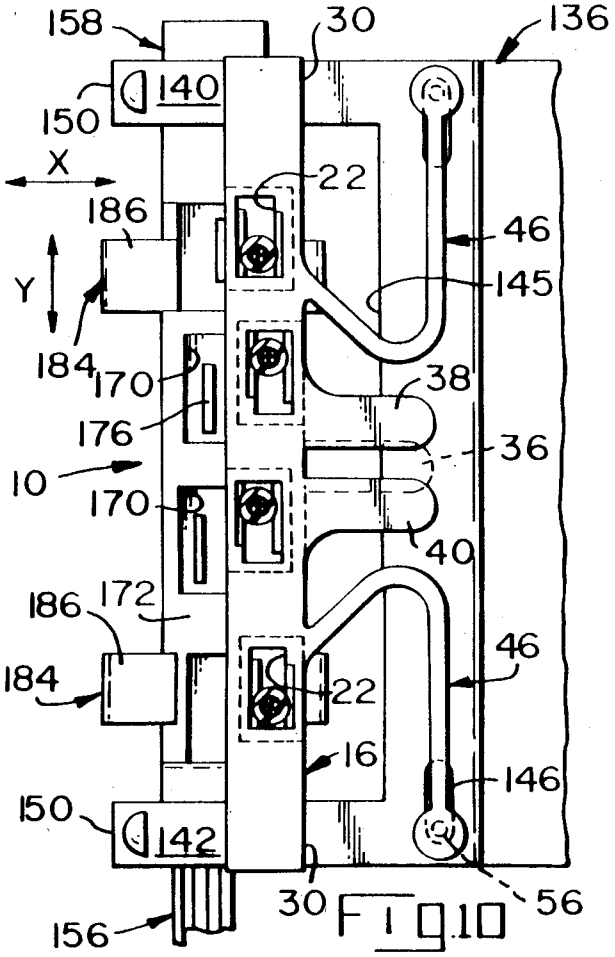
FIG. 10 is an end view of the electrical connector movably mounted in a bracket and with a matable bus bar shroud positioned to the left and down relative to the electrical connector.

As shown in FIG. 8, electrical connector 10 is movably attached to mounting bracket 136 with rails 140, 142 thereon being slidingly received in slots 30, fingers 56 are slidingly received in oval holes 146 and plate edge 145 is slidingly received in space 44 between guide fingers 36, 38, 40. As rails 140, 142 enter slots 30, slot fingers 34 are cammed out by curved surfaces 152 and snap back in behind shoulders 154 to retain connector 10 on bracket 136. J-shaped arms 46 resiliently hold connector 10 centered in bracket space 144 as shown in FIG. 10.

Figure 7:
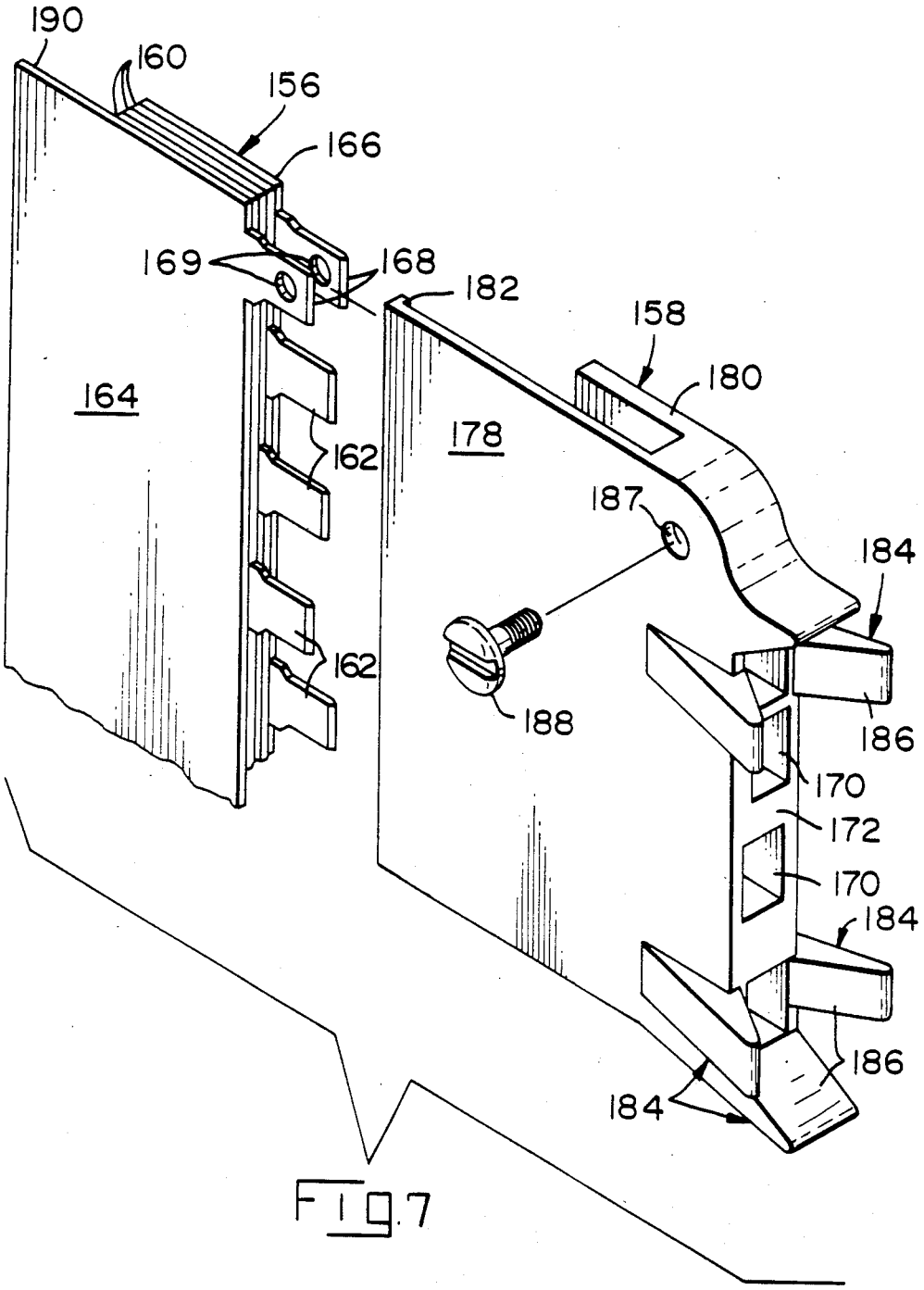
FIG. 7 is a perspective exploded view of a bus bar and bus bar shroud matable with the electrical connector of FIGS. 1 and 2.

FIG. 7 shows bus bar 156 and bus bar shroud 158 that is matable with electrical connector 10. Bus bar 156 includes a plurality of conductive plates 160 separated one from the other by a thin dielectric material (not shown). Each conductive plate 160 includes a forwardly projecting tab terminal 162. The spacing and location of tab terminals 162 corresponds to the spacing and location of respective shells 18 on support member 16. Conductive plates 160 are securely sandwiched between insulative plates 164, 166 made from a suitable rigid dielectric material. Both insulative plates 164, 166 include forwardly projecting securing aligned tabs 168 having aligned holes 169 therethrough. Further, plate 164 extends rearwardly further than plates 160, 166.

Bus bar shroud 158 includes a plurality of tab terminal receiving passages 170 which are spaced, located and sized to telescopingly receive shells 18 therein through the passage opening on front face 172 of shroud 158. The passage opening on rear face 174 are slots, one such being indicated by reference numeral 176 in FIG. 9, which are spaced and located to receive respective tab terminals 162 therethrough.

Side wall 178 of shroud 158 extends further rearwardly than opposing side wall 180 and includes inwardly projecting lip 182 on the free end thereof.

Forwardly projecting fingers 184 are provided on all the sides of front face 172 and include beveled surfaces 186 which slope in towards passages 170. Hole 187, located near one end of shroud 158, extends therethrough in a direction normal to passages 170 and receives mounting screw 188 therein.

Figure 9:
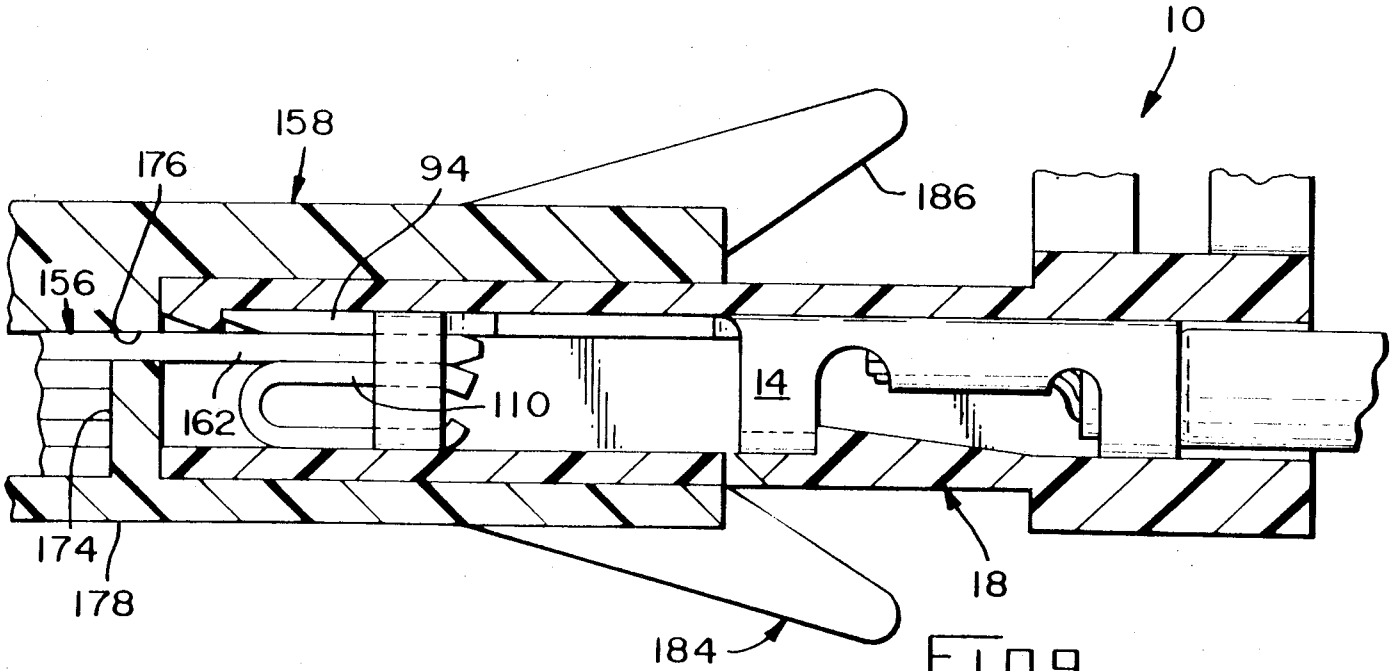
FIG. 9 is the same view as in FIG. 6 but with a bus bar tab terminal mated with the contact.

As shown in FIGS. 8 and 9, bus bar 156 is mounted in shroud 158 with screw 188 extending through holes 169 in securing tabs 168 on insulative plates 164, 166. Tab terminals 162 enter into respective passages 170 through slots 176. Further insulative plate 164 lies against side wall 178 with inwardly projecting lip 182 catching rear edge 190 on plate 164.

As noted above, shroud 158 is mated to connector 10 by sliding onto shells 18 as indicated by line 192 in FIG. 8. Beveled surfaces 186 on fingers 184 guide and channel shells 18 into passages 170 opening out onto front face 172 of shroud 158. As shown in FIG. 9, tab terminals 162 are received in contacts 14 between portion 98 of blade 94 and cantilever spring arm 110.

Figure 11:
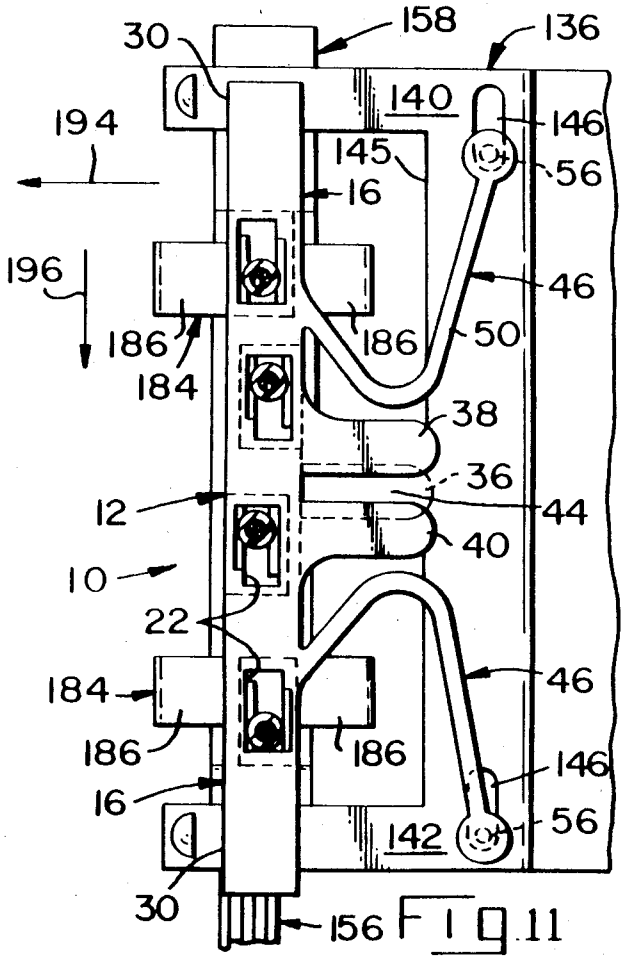
FIG. 11 is the end view of FIG. 10 with the electrical connector having been moved within the bracket into alignment with the bus bar shroud.

FIGS. 10 and 11 illustrate how electrical connector 10 and shroud 158 are mated under a misalignment condition. The assumptions are that shroud 158 is fixed and bracket 136 can move towards and away from shroud 158 in a straight line only; i.e., bracket 136 cannot move in the x and/or y directions indicated by the arrows so marked in FIG. 10.

As noted above, connector 10 in FIG. 10 is centered in bracket 136; i.e., J-shaped arms 46 resiliently hold connector 10 approximately half way between plate edge 145 and rail free ends 150 and rails 140, 142 are in respective slots 30 an equal distance. As shown in FIG. 10 bracket 136 is located such that connector 10 is to the right and above shroud 158. As bracket 136 moves forward, fingers 184 on shroud 158 engage shells 18, both top and bottom and on both sides and beveled surfaces 186 on fingers 184 deflect connector 10 leftwardly and downwardly, as shown in FIG. 11, so that shells 18 enter passages 170 directly on.

As shown in FIG. 11, in moving to the left, indicated by arrow 194, connector 10 is guided by rails 140, 142 in slots 30 and in moving down, indicated by arrow 196, connector 10 is guided by plate edge 145 sliding in space 44 defined by guide flanges 36, 38, 40. Concurrently, in response to connector 10 being forced outwardly, J-shaped arms 46 resiliently spread apart as shown in FIG. 11, and in response to connector 10 being forced downwardly, long portion 50 of the upper arm 46 moves down to the extent permitted by finger 56 in oval hole 146.

Upon unmating, J-shaped arms 46 will center connector 10 within space 144 as shown in FIG. 10.

We claim:

1. An electrical connector for use with a bracket having a pair of spaced apart rails attached to and extending from a plate, said electrical connector comprising:

a plurality of conductive contacts; and a dielectric housing including:

an elongated support member having a slot at each end and a pair of resilient arms attached thereto and extending outwardly therefrom; and a plurality of shells attached to and extending from said support member and containing said conductive contacts, said electrical connector being adapted to be movably mounted on the bracket and in a central location relative to said rails with said rails being slidingly received in respective said slots and with free ends of said resilient arms being attached to said plate so that upon said electrical connector being moved by an external force either or both in a parallel or perpendicular direction with respect to said rails and said plate and with said arms being resiliently deformed thereby, said resilient arms will restore said electrical connector to said central location upon the removal of said external force moving said electric connector.

2. An electrical connector for movement in the X and/or Y directions for matable engagement with a complementary electrical connector, comrprising:

dielectric housing means including support means and a plurality of spaced-apart, substantially parallel shell means with said shell means extending outwardly from a front surface of said support means, said support means and shell means having passage means extending therethrough for receiving conductive contact means therein, said support means further having mounting means at outer ends thereof for slidably mounting said housing means onto rail means of a support plate; and resilient arm means extending outwardly from a side surface of said support means and having projection means at free ends disposable within elongated holes in the support plate, said resilient arm means, in cooperation with said mounting means, enabling said electrical connector to move in and X and/or Y direction relative to said rail means during mating engagement between said electrical connector and said complementary electrical connector.

3. The electrical connector of claim 2 further including first guide means extending outwardly from the same side surface of said support means as said resilient arm means, said guide means adapted to slidingly receive an edge of said support place to guide the movement of said electrical connector in the Y direction.

4. The electrical connector of claim 3 further including second guide means on free ends of said support means, said second guide means adapted to slidingly receive said rail means to guide the movement of said electrical connector in the X direction.

5. The electrical connector of claim 1 further including conductive contact means disposed in said passage means, said contact means having tab terminal receiving means at one end and wire receiving means at another end.

6. The electrical connector of claim 1 wherein said resilient arm means include J-shaped arms having short and long portions with a curved portion therebetween, said arms being attached to said support means with said long portions being parallel thereto.

7. The electrical connector of claim 5 wherein said tab terminal receiving means on said contact means include a space defined by a blade and spring means adjacent to said blade.

8. The electrical connector of claim 7 wherein said spring means include an asymmetrical U-shaped member with a first leg being spaced from and parallel to said blade and a resilient second leg extending obliquely towards said blade.

9. The electrical connector of claim 8 wherein said U-shaped member is positioned adjacent said blade by strap means attached to and extending between an edge of said blade and an edge of said first leg.

10. An electrical connector for movement in the X and/or Y directions for matable engagement with a complementary electrical connector, comprising:

dielectric housing means including support means and shell means with said shell means attached to said support means, said support means and shell means having passage means extending therethrough for receiving conductive contact means therein, said support means further having mounting means at outer ends thereof for slidably mounting said housing means onto rail means of a support plate; and resilient arm means extending outwardly from a side surface of said support means and having projection means at free ends disposable within elongated holes in the support plate, said resilient arm means, in cooperation with said mounting means, enabling said electrical connector to move in an X and/or Y direction relative to said rail means during mating engagement between said electrical connector and said complementary electrical connector.

* * * * *